US007233259B2

(12) United States Patent
Gibson et al.

(10) Patent No.: US 7,233,259 B2
(45) Date of Patent: Jun. 19, 2007

(54) TRAFFIC CONTROL SIGN ASSEMBLY

(76) Inventors: Thomas W. Gibson, 2914 21st St., Rockford, IL (US) 61109; Todd M. Gibson, 3520 Bunkerhill, Algonquin, IL (US) 60102

( * ) Notice: Subject to any disclaimer, the term of this patent is extended or adjusted under 35 U.S.C. 154(b) by 208 days.

(21) Appl. No.: 11/062,727

(22) Filed: Feb. 22, 2005

(65) Prior Publication Data

US 2006/0012486 A1 Jan. 19, 2006

Related U.S. Application Data

(60) Provisional application No. 60/588,324, filed on Jul. 16, 2004.

(51) Int. Cl.
*G09F 21/02* (2006.01)
*G08G 1/095* (2006.01)

(52) U.S. Cl. ..... 340/907; 340/908; 40/586

(58) Field of Classification Search ..... 340/907–932.1, 340/321, 815.45; 40/586, 442–444, 464, 40/572; 362/246, 800, 812, 33–35
See application file for complete search history.

(56) References Cited

U.S. PATENT DOCUMENTS 4,827,245 A * 5/1989 Lipman ..... 340/321
5,276,424 A 1/1994 Hegemann
D351,807 S 10/1994 Smith et al.
5,585,783 A * 12/1996 Hall ..... 340/473
5,635,902 A * 6/1997 Hochstein ..... 340/433
D382,218 S 8/1997 Hall
5,687,500 A 11/1997 Lamparter
5,955,956 A * 9/1999 Stendahl et al. ..... 340/635
6,009,650 A 1/2000 Lamparter
6,029,382 A 2/2000 Kochanowski
6,150,957 A * 11/2000 Henz et al. ..... 340/908
6,198,410 B1 3/2001 White et al.
6,204,777 B1 * 3/2001 Lyons ..... 340/908
6,239,691 B1 5/2001 Preisler
6,265,969 B1 * 7/2001 Shih ..... 340/468
6,407,675 B1 6/2002 Mumford et al.
6,409,358 B1 6/2002 Grover
6,422,714 B1 7/2002 Hubbell
6,515,583 B1 2/2003 Lamparter et al.
6,519,884 B1 2/2003 Duhamel
6,693,556 B1 2/2004 Jones et al.
6,850,172 B2 * 2/2005 Becka ..... 340/932.2
6,900,735 B2 * 5/2005 Guerrieri et al. ..... 340/815.4
2005/0040970 A1 * 2/2005 Hutchins et al. ..... 340/907

* cited by examiner

*Primary Examiner*—Daniel Wu
*Assistant Examiner*—Jennifer Mehmood
(74) *Attorney, Agent, or Firm*—McDonnell Boehnen Hulbert & Berghoff LLP

(57) ABSTRACT

The present invention provides a traffic control sign assembly that comprises a sign having a central opening. Control consoles are positioned on opposite sides of the sign in centered relation to the central opening and are connected to one another and to the sign. A two-sided bread board type LED light panel is mounted in the central opening within the control consoles with light-diffusing panels mounted over the LED light panel. A power source is connected to the LED light panel. A first silk screen with legend "STOP" and a second silk screen with legend "STOP" or "SLOW" is located on the back of each of the light-diffusing panels in alignment with the LED light panel. Switch means for turning said power source "ON" in a holding or a flashing mode or "OFF" is provided. A handle assembly is secured to the sign.

9 Claims, 17 Drawing Sheets

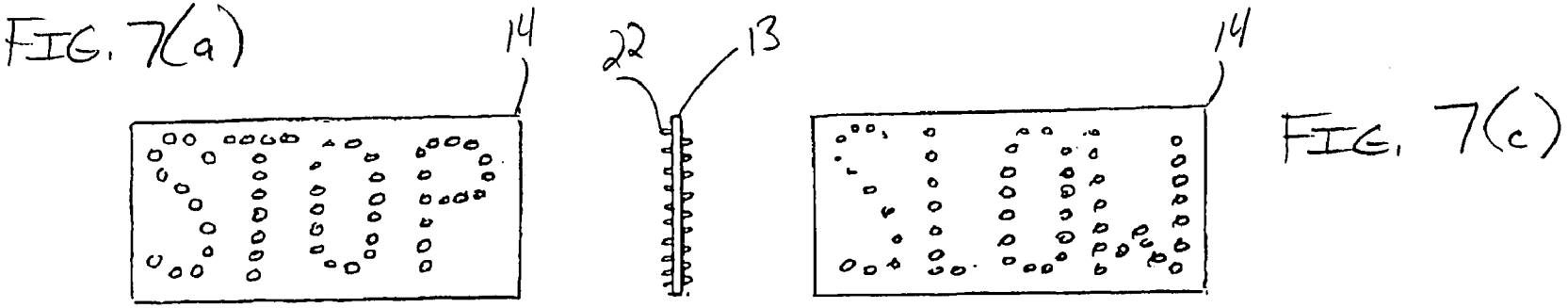
FIG. 7(a)
FIG. 7(b)
FIG. 7(c)
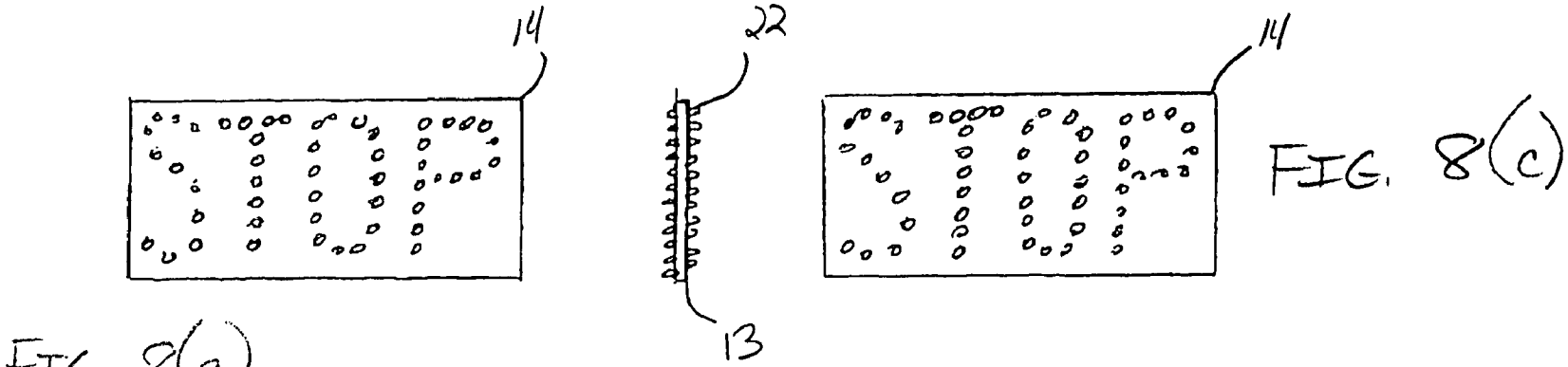
FIG. 8(a)
FIG. 8(b)
FIG. 8(c)

TRAFFIC CONTROL SIGN ASSEMBLY

PRIOR HISTORY

This application is a non-provisional patent application claiming priority to provisional U.S. Patent Application No. 60/588,324, filed in the United States Patent and Trademark Office on Jul. 16, 2004.

BACKGROUND OF THE INVENTION

1. Field of the Invention

The present invention relates to vehicular traffic safety devices, in particular to signal lights and sign apparatuses. More specifically, the present invention is primarily intended as a traffic control sign assembly.

2. Description of the Related Art

Traffic control devices have been used in many applications for decades. Such devices range from hand-held signs to traffic signs and lights. Applications vary and include school crossings, construction sites, airports, roadside emergencies, trucking usages, emergency equipment and so forth. These devices are used to alert the public and oncoming traffic of potential safety issues and are also used to protect those located at the locations at issue. Many devices have been prepared and used for these applications; however none of these devices, to the knowledge of the inventors, provide protection and warning to oncoming traffic at such distance and with such coverage as with the present invention hereafter disclosed.

Existing devices, such as the Illuminated Traffic Sign of U.S. Pat. No. 6,198,410 B1, which issued to White et al., disclose an illuminatable traffic sign that is secured to a post and has indicia disposed thereon and a plurality of lights positioned along an outer periphery and along the indicia. However, the White apparatus does not appear to teach the light enhancement and coverage concepts of the present invention and the lights used in the White apparatus only appear to be as effective as their individual wattages.

In like manner, U.S. Pat. No. 6,029,382 which issued to Kochanowski, discloses a Reflective Sign that includes a face member that has a plurality of cube corners disposed along a back surface for light reflection. However, the '382 device relies upon reflection of oncoming light and does not provide an enhanced lighted sign assembly that can be seen at dusk or night without the use of lights in oncoming vehicles, flashlights, and the like.

Other patented sign devices including those of U.S. Pat. Nos. 6,009,650; 6,422,714 B1; 5,276,424; 6,409,358 B1; 6,407,675 B1; and 6,239,691 B1 provided lighted sign devices. However, none provide the enhanced visual clarity, brightness, and coverage features needed to warn oncoming traffic and the public from distances as far away as ⅛ mile and in a 170 degree line of sight from the center of the sign. It is therefore important and necessary that a traffic control sign assembly be developed that provides enhanced visual clarity, brightness, and coverage including up to distances of ⅛ mile and at nearly any angle from which the sign can be turned. The traffic control sign assembly must be highly visible, distinctly display the appropriate warning messages, capable of quickly being powered by various means, sturdy, lightweight, adaptable to different sites and under different working conditions, and be easy to use and manufacture.

Other objects of my invention, as well as particular features, elements, and advantages thereof, will be elucidated in, or apparent from, the following description and the accompanying drawing figures.

SUMMARY OF THE INVENTION

The present invention provides a vehicle signal light assembly comprising: a sign having a central opening that is defined by an annular sign rim. A pair of control consoles is positioned on opposite sides of said sign and in centered relation to said central opening. A two-sided bread board type LED light panel is mounted in said central opening in sandwiched relation between said control consoles and light-diffusing panels (diffused or prismatic panels) are mounted in said control console in central alignment on opposite sides of said central opening. Batteries are mounted on an underside of said control consoles and are connected to said two-sided bread board type LED light panel for providing electrical power to light said two-sided bread board type LED light panel. Means connecting said control consoles to said sign and each other in unitary assembly are also provided. A first silk screen with legend "STOP" on back of one of said diffused or prismatic panels is mounted in one of said control consoles and a second silk screen with legend "STOP" or "SLOW" on back of another of said diffused or prismatic panels is mounted in another of said control consoles. Switch means for turning said batteries "ON" in a holding or a flashing mode and for turning said batteries "OFF" are provided and a handle assembly is secured to said sign for enabling the sign to be hand held by a person.

In another embodiment, a vehicle signal light assembly is provided, which vehicle signal light assembly is designed to be hand held, pole (telescopically) assisted, or hands-free stand-mounted, and comprises a flat plate sized and shaped in the form of a traffic sign that has a central opening defined by an annular sign rim. A control console structure is secured in centered relation in said central opening and is peripherally bounded by said annular rim. A two-sided bread board type LED light panel is mounted in said control console structure and diffused or prismatic panels are mounted on opposite sides of said control console structure on opposite sides of said central opening. Batteries are mounted on an underside of said control console structure and are connected to said two-sided bread board type LED light panel thus providing electrical power to light said two-sided bread board type LED light panel. Means connecting said control console structure internally and to said sign in unitary assembly are provided. A first silk screen with a traffic legend on back of one of said diffused or prismatic panels is mounted in said control console structure while a second silk screen with another traffic legend on back of another of said diffused or prismatic panels is mounted on an opposite side of said control console structure. Switch means for turning said batteries "ON" in a holding or a flashing mode and for turning said batteries "OFF" is also provided.

In still another embodiment, the present invention provides a traffic control sign assembly comprising a sign having a central opening defining an annular sign rim and opposing sides. A control console is positioned on each opposing side of said sign in centered relation to said central opening and means connecting said control consoles to said sign and to each other in unitary assembly are provided. A double-sided light panel (optionally mirrored) having LED's is mounted on opposing surfaces and is centrally located in said connected control consoles. A prismatic panel is centrally mounted in each control console over each opposing surface of said optionally mirrored double-sided LED light panel and said central opening. A power source is electrically connected to said double-sided LED light panel and a handle assembly is secured to said sign for supporting said sign.

Finally, in another embodiment, the present invention provides a traffic control sign assembly kit. The kit essentially comprises: a traffic sign (assembly); a modular handle assembly or telescoping pole assembly; a power source (e.g. batteries, an inverter and cord, vehicular cigarette lighter cord, external battery cord); various accessories; and a carrying case. Said traffic sign assembly comprises a traffic sign having a central opening defining an annular sign rim and opposing sides. A control console is positioned on each opposing side of said traffic sign in centered relation to said central opening. Means connecting said control consoles to said traffic sign and to each other in unitary assembly are provided. A dual-sided LED light panel (optionally mirrored) is centrally located within said connected control consoles and a prismatic panel is centrally mounted in each control console over the optionally mirrored, dual-sided LED light panel and the central opening. The power source is electrically connected to the optionally mirrored LED light panel and the modular handle or telescopic pole assembly and includes screwed-in attachment means for constructing and for securing the modular handle or telescopic pole assembly to itself and to said traffic sign. The carrying case is provided for containing the traffic sign (assembly); the modular handle assembly or telescoping pole assembly; the power source (e.g. batteries, an inverter and cord, vehicular cigarette lighter cord, external battery cord); and various other accessories as may be required.

The present invention therefore provides a traffic control sign assembly that provides enhanced visual clarity, brightness, and coverage including up to distances of ⅛ mile and at nearly any angle from which the sign can be turned. The traffic control sign assembly is highly visible, distinctly displays the appropriate warning messages, is capable of quickly being powered by various means and is sturdy, lightweight, adaptable to different sites and under different working conditions, and is easy to use and manufacture.

DESCRIPTION OF THE DRAWINGS

Other features of our invention will become more evident from a consideration of the following brief description of our patent drawings, as follows:

FIG. 7(*a*) is a plan view of a first side of a first prismatic panel of the traffic control sign bearing the legend, "STOP".

FIG. 7(*b*) is an edge view of a first two-sided bread board type LED light panel of the traffic control sign assembly.

FIG. 7(*c*) is a plan view of the second side of the first prismatic panel shown in FIG. 7(*a*) bearing the legend, "SLOW".

FIG. 8(*a*) is a plan view of a first side of a second prismatic panel of the traffic control sign bearing the legend, "STOP".

FIG. 8(*b*) is an edge view of a second two-sided bread board type LED light panel of the traffic control sign assembly.

FIG. 8(*c*) is a plan view of the second side of the second prismatic panel shown in FIG. 8(*a*) bearing the legend, "STOP".

FIG. 15(*a*) is a fragmentary edge view of the traffic control sign assembly shown in FIG. 15.

FIG. 15(*b*) is a fragmentary cross-sectional view of the traffic control sign assembly as taken from FIG. 15.

FIG. 15(*c*) is a depiction of a battery compartment of the traffic control sign assembly shown in FIG. 15.

FIG. 18(*a*) is an end view of one edge molding structure as shown in FIG. 18.

FIG. 18(*b*) is a fragmentary end view of the edge molding structure shown in FIG. 18(*a*) attached to an upper edge of the light panel shown in FIG. 18.

FIG. 20(*b*) is a comparative plan view of a first side of the traffic control sign assembly bearing the legends, "STOP-SLOW".

FIG. 20(*c*) is a comparative plan view of a first side of the traffic control sign assembly bearing the legends, "SLOW-SLOW".

DETAILED DESCRIPTION OF THE PREFERRED EMBODIMENT(S)

Figure 1:
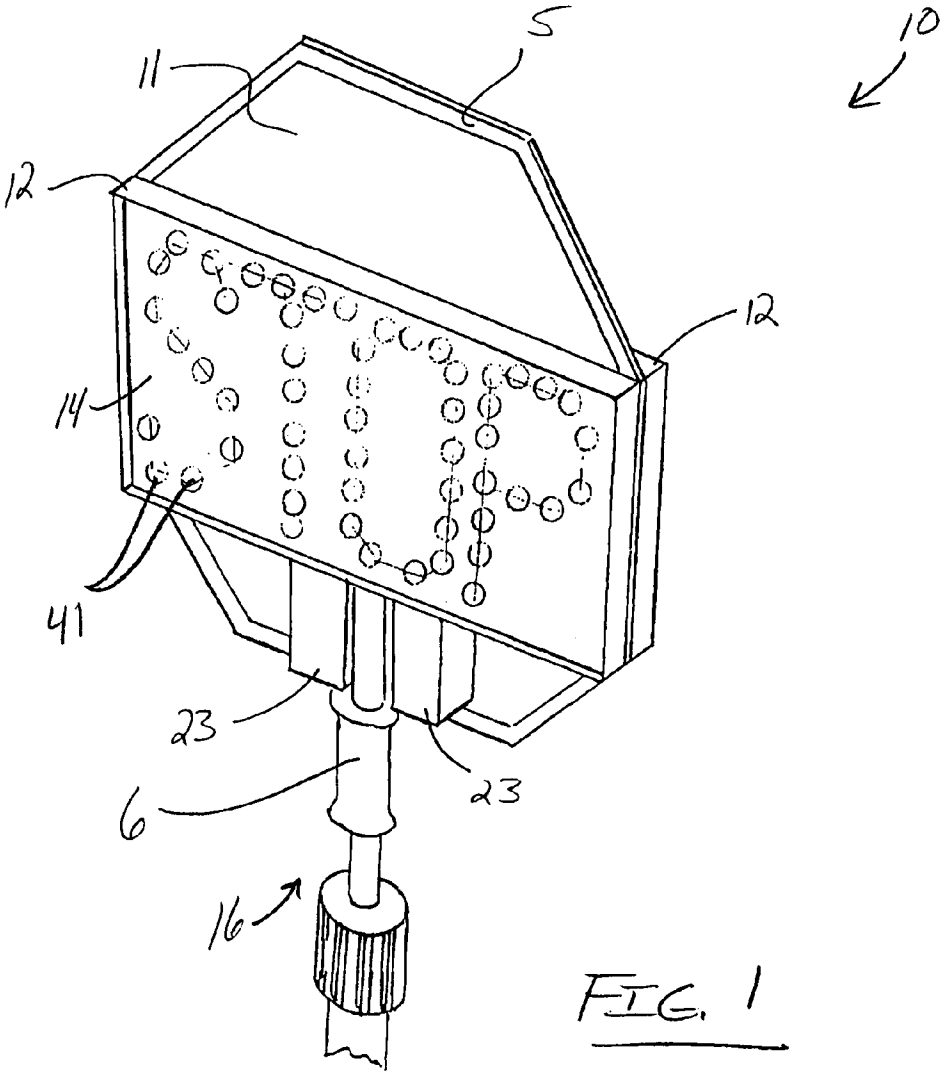
FIG. 1 is a fragmentary top perspective view of the traffic control sign assembly in an assembled state showing a first handle assembly.

Referring now to the drawings, the present invention concerns a traffic control sign assembly, also known as a traffic control sign assembly 10 or a vehicle signal light assembly 10 as generally illustrated and referenced in FIGS. 1, 2, 22, and 23. It is contemplated that traffic control sign assembly 10 is particularly used in various settings and circumstances to warn oncoming motorists and people of safety and emergency issues. In this last regard, by way of example, it is contemplated that traffic control sign assembly 10 may be used in situational scenarios such as at school, construction, industrial, fire safety, law enforcement, and at emergency sites. As previously discussed above under the section entitled, BACKGROUND OF THE INVENTION, from a safety standpoint, it is very important to provide a traffic control sign assembly that provides enhanced visual clarity, brightness, and coverage including up to distances of ⅛ mile and at nearly any angle from which the sign can be turned. Thus, it is contemplated that traffic control sign assembly 10 must be highly visible, distinctly display the appropriate warning messages, be capable of quickly being powered by various means, be sturdy, lightweight, adaptable to different sites and under different working conditions, and be easy to use and manufacture. The present invention as embodied in traffic control sign assembly 10 provides these key features and further satisfies these needs. It is not intended that the present invention be limited solely to the specifics disclosed, rather it is intended that the scope of the present invention also include other traffic control sign devices and the like.

Figure 2:
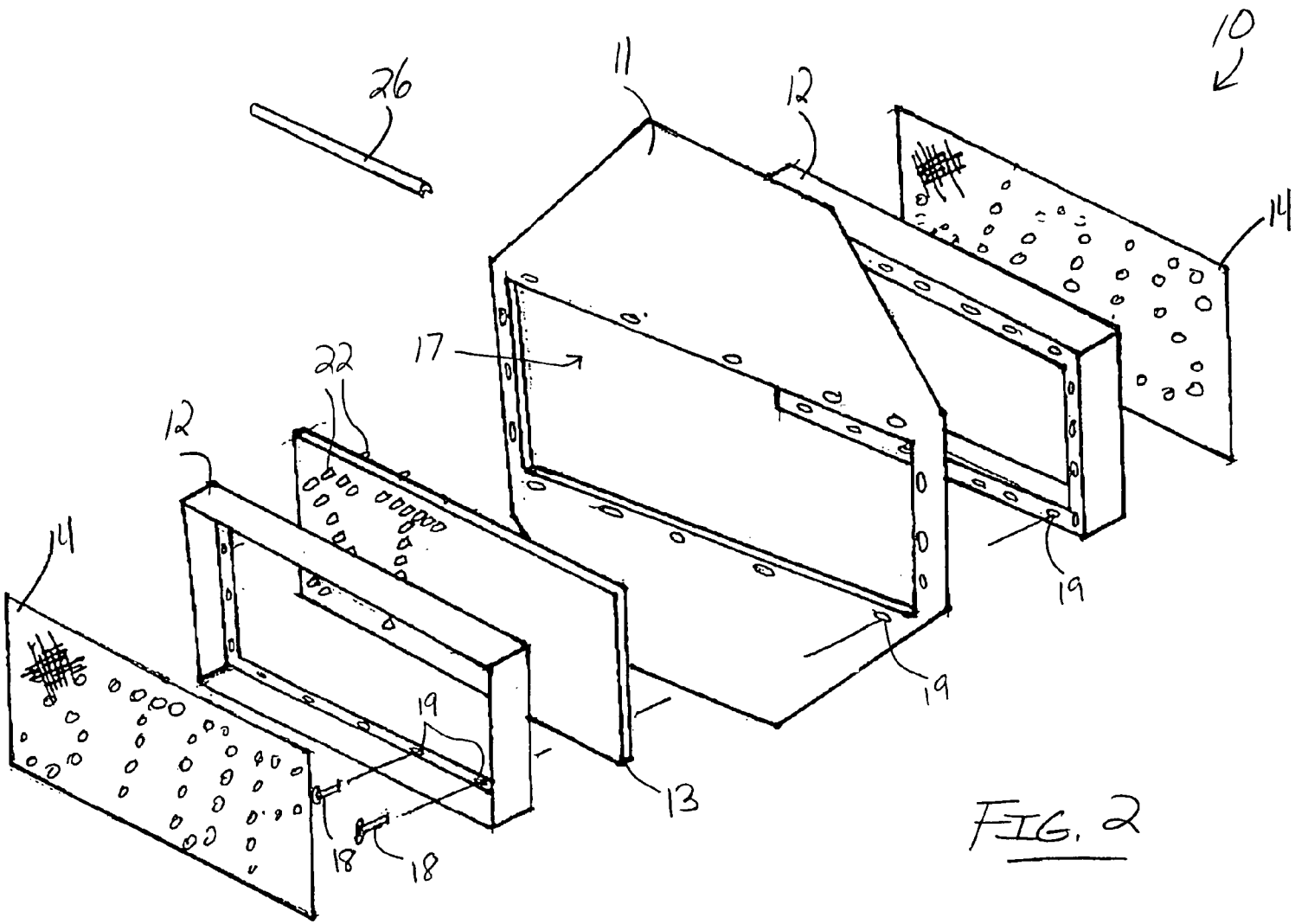
FIG. 2 is a fragmentary exploded perspective view of the traffic control sign assembly.

A preferred embodiment of the present invention is illustrated in FIGS. 1 and 2, namely, a traffic control sign assembly 10 or vehicle signal light assembly. It will be seen from an inspection of FIGS. 1 and 22 that (glass bead type) reflective tape 5 can be mounted on edges of both sides of said traffic sign for increased visibility of said traffic sign. Traffic control sign assembly 10 preferably comprises a sign 11 as is illustrated and referenced in FIGS. 1–4, 9–13, 15, 15(*a*), 15(*b*), 16, and 17; a pair of control consoles 12 as illustrated and referenced in FIGS. 1, 2, 5, 6, 9–15(*b*), 16, and 17; a two-sided bread board type LED light panel 13 as illustrated and referenced in FIGS. 2, 7(*b*), 8(*b*), 12, 13, and 18; light-diffusing (diffused or prismatic) panels 14 as illustrated and referenced in FIGS. 2, 7(*a*), 7(*c*), 8(*a*), 8(*c*), and 14; batteries 15 as illustrated and referenced in FIG. 15(*c*) and 19; means connecting control consoles 12 to sign 11 and each other in unitary assembly; first and second silk screens 20 as illustrated and referenced in FIG. 14; switch means; and a handle assembly 16 as generally illustrated and referenced in FIGS. 1, 9–12, 15, and 15(*a*).

Figure 3:
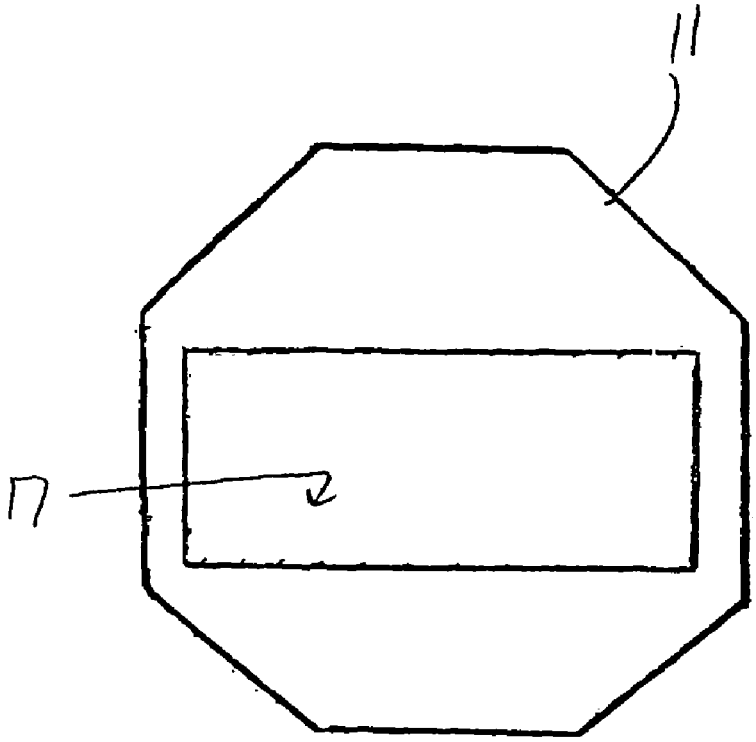
FIG. 3 is a front plan view of the sign of the traffic control assembly.
Figure 4:
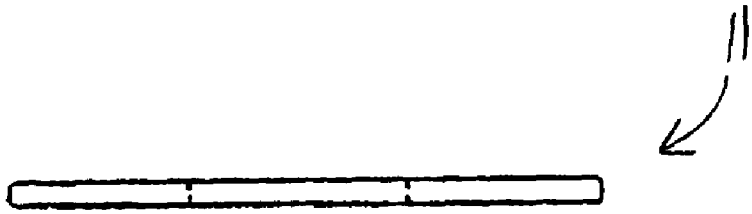
FIG. 4 is an edge view of the sign shown in FIG. 3.
Figure 5:
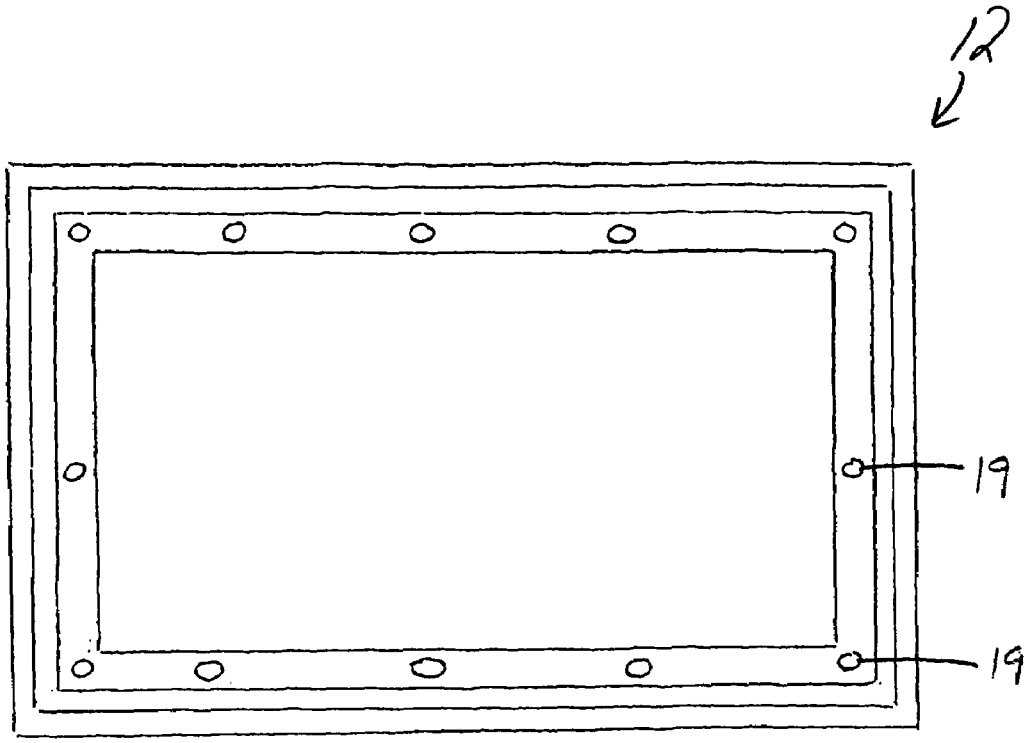
FIG. 5 is a front plan view of one control console of the traffic control sign assembly.
Figure 17:
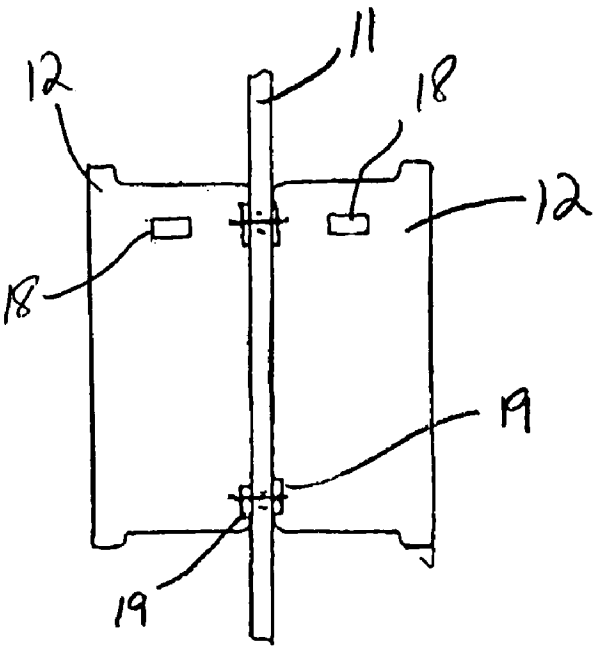
FIG. 17 is a fragmentary side plan view of the fourth preferred traffic control sign assembly showing two control consoles.
Figure 16:
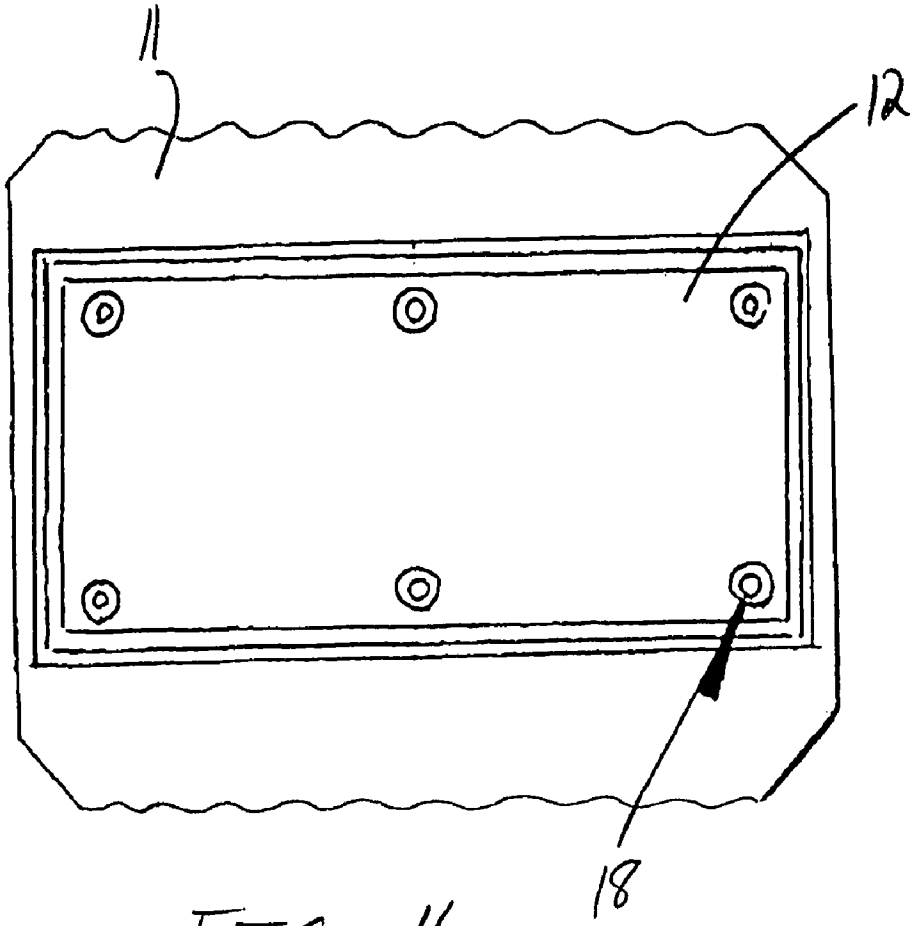
FIG. 16 is a fragmentary plan view of the fourth preferred traffic control sign assembly showing one control console.
Figure 18:
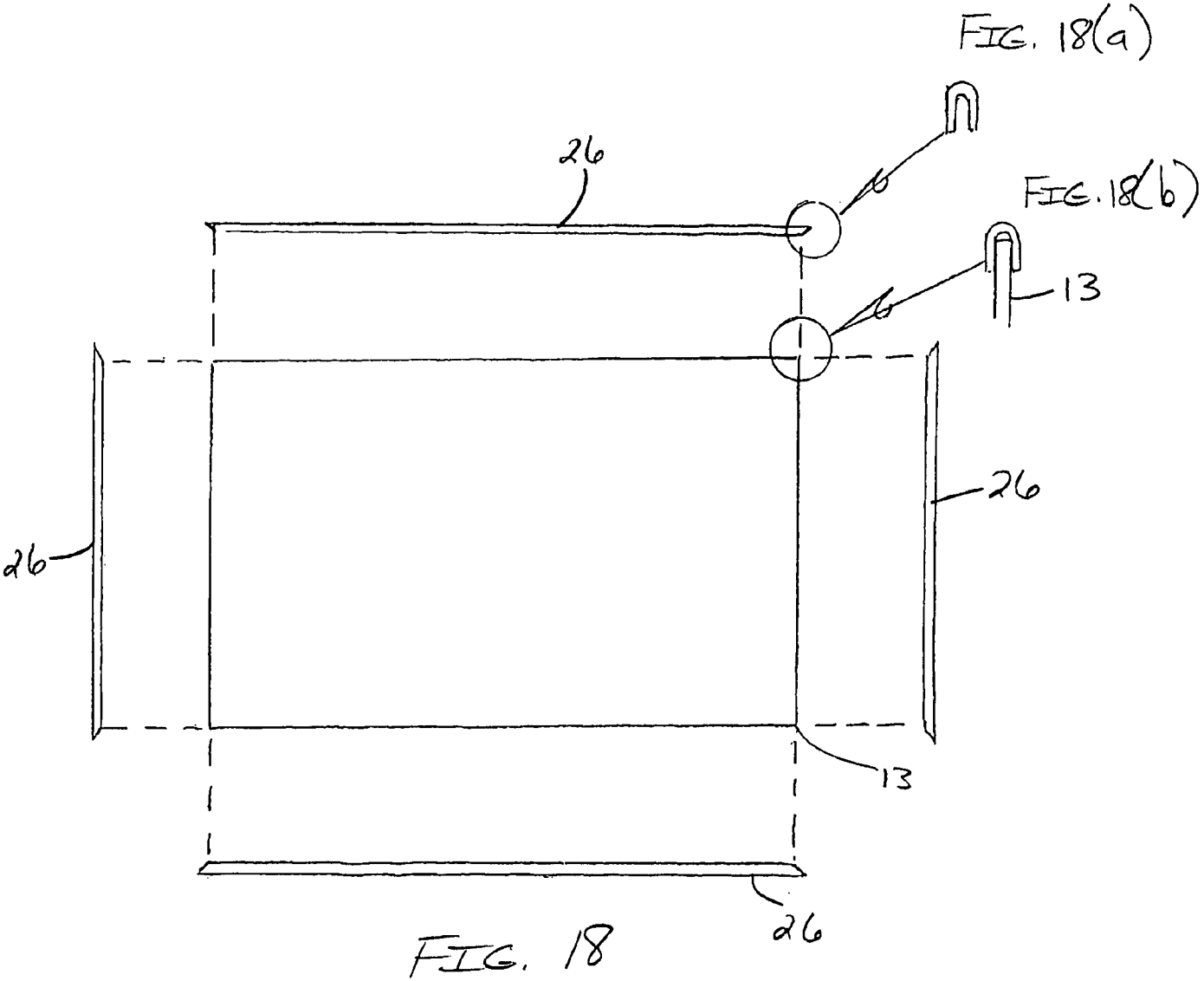
FIG. 18 is a plan view of a bread board type LED light panel showing a series of edge molding structures exploded from the light panel.
Figure 19:
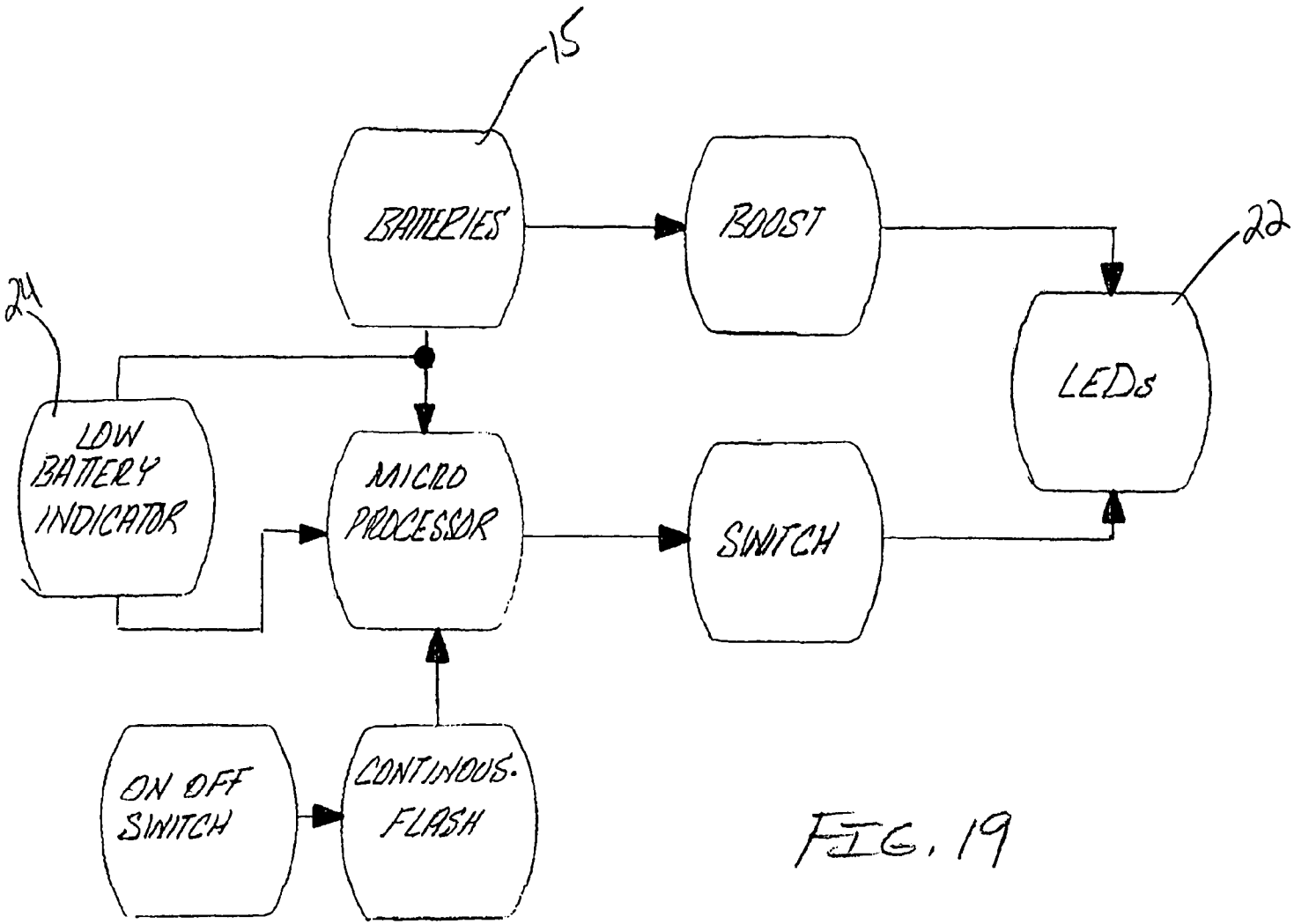
FIG. 19 is a circuit diagram diagrammatically depicting certain electrical circuitry of the traffic control sign assembly.

Sign 11 preferably comprises a central opening 17 as generally referenced in FIGS. 2 and 3. It will be understood from an inspection of the noted figures that central opening 17 is preferably defined by an annular sign rim. It will be further understood from a consideration of the noted figures that control consoles 12 are preferably positioned on opposite sides of sign 11 and are preferably in centered relation to central opening 17. Light panel 13 is preferably mounted in central opening 17 in sandwiched relation between control consoles 12. Diffused or prismatic panels 14 are preferably mounted in control consoles 12 in central alignment on opposite sides of central opening 17. Batteries 15 are preferably mounted on an underside of control consoles 12 and connected to two-sided bread board type LED light panel 13, thus providing electrical power to light two-sided bread board type LED light panel 13. The means connecting control consoles 12 to sign 11 and each other in unitary assembly may preferably be defined by rivets 18 and rivet-receiving structure 19 as both are illustrated and referenced in FIG. 2. Rivets 18 are further referenced in FIGS. 12–15, 16 (6 rivets 18), and 17. Rivet-receiving structures (apertures) 19 are further referenced in FIGS. 5 and 17. It will be seen from a comparative inspection of the noted figures that the number of rivets 18 and corresponding rivet-receiving structures 19 may vary depending on the application.

In one embodiment, first silk screen 20 bearing the legend "STOP" appears on back of one of diffused or prismatic panels 14 is mounted in one of control consoles 12 and second silk screen 20 with bearing the legend "STOP" or "SLOW" appears on back of another of diffused or prismatic panels 14 mounted in another of control consoles 12. The switch means, designed for turning batteries 15 "ON" in a holding or a flashing mode and for turning batteries 15 "OFF" have been generally referenced at 21 in FIGS. 15, 15(*a*), and 15(*b*). Handle assembly 16 is preferably secured to sign 11 for enabling sign 11 to be hand held by a person.

Thus, traffic control sign assembly 10 preferably comprises sign 11 having central opening 17 that is defined by an annular sign rim. Sign 11 can be octagon shaped, such as for a standard stop sign, as has been generally illustrated in the noted figures for ease of illustration, or sign 11 can be shaped as deemed necessary, it being noted that signs take on various shapes and sizes. In addition, sign 11 can be painted with reflective paint or have reflective tape, such as glass bead type reflective tape, attached to its surface and edges to enhance the display of the message. For example, a red color can be used for a "STOP" message and orange for "SLOW" and these colors can be painted to conform with standard shapes as used in traffic laws, such as octagonal for stop and triangular for yield and so forth. Moreover, sign 11 may be silk screened to enhance the messages displayed and the size and presentation of the sign is intended to meet all federal, state, and local codes. It is also intended that these features apply to both sides of sign 11 as it is dual-sided as explained in more detail below.

The pair of control consoles 12 is preferably positioned on opposite sides of sign 11 and in centered relation to central opening 17. Control consoles 12 are central to housing certain lights and circuitry of the present invention. It is contemplated that control consoles 12, and other parts to this invention are constructed of light-weight plastic, such as standard ABS, using injection or vacuum molding processes as are standard in the industry. Moreover, these and other parts are light-weight and the traffic control sign assembly 10 itself is intended to weigh approximately 5 pounds or less including batteries 15 and the like so that it may be easily held or supported by a person.

A further key feature of the present invention is two-sided bread board type LED light panel 13. Light panel 13 is preferably mounted in central opening 17 in sandwiched relation between control consoles 12. Light panel 13 is preferably a rectangular-shaped, double-sided, printed circuit board. Optionally, light panel 13 may comprise or be constructed of a mirror type material so as to increase its brightness and reflection capabilities. Light panel 13 is also known in the art as a bread board. In one embodiment, light panel 13 comprises LED lights 22 as illustrated and referenced in FIGS. 2, 7, 8, 12, 13, 14, and 19. LED lights 22 are preferably placed or surface mounted upon the circuit board to form or print the message that traffic control sign assembly 10 will state to oncoming traffic and people. LED lights 22 are preferably high-intensity lights and may be colored as deemed effective for the usage and situation. In a preferred embodiment, LED lights 22 are placed on each side of light panel 13 to form a legend or message on each side of light panel 13 so that an appropriate traffic control message will be communicated simultaneously to oncoming traffic on both sides of traffic control sign assembly 10. In a preferred embodiment, the legend(s), message(s), or advisories printed by LED lights 22 is/are "STOP" and "SLOW" as may be seen from a general inspection of FIG. 7. In this last regard, it is contemplated that traffic control sign assembly 10 may either state (on opposite assembly sides) "STOP-STOP" (as is generally depicted in FIG. 8) or "STOP-SLOW" for safety and traffic control purposes, such as would be the case at an accident, in construction zones, or at a school crossing scene.

Figure 20A:
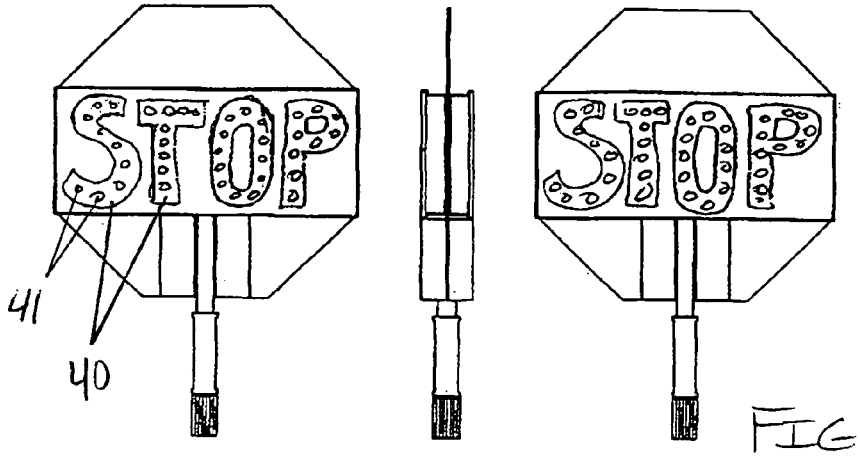
FIG. 20(*a*) is a comparative plan view of a first side of the traffic control sign assembly bearing the legends, "STOP-STOP".
Figure 20B:
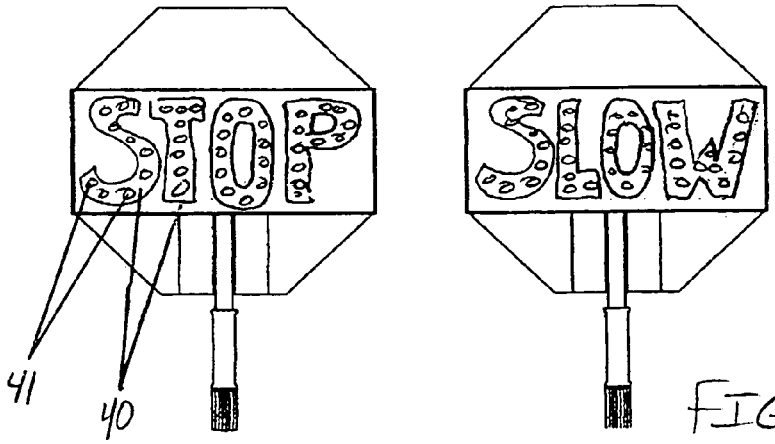
Figure 20C:
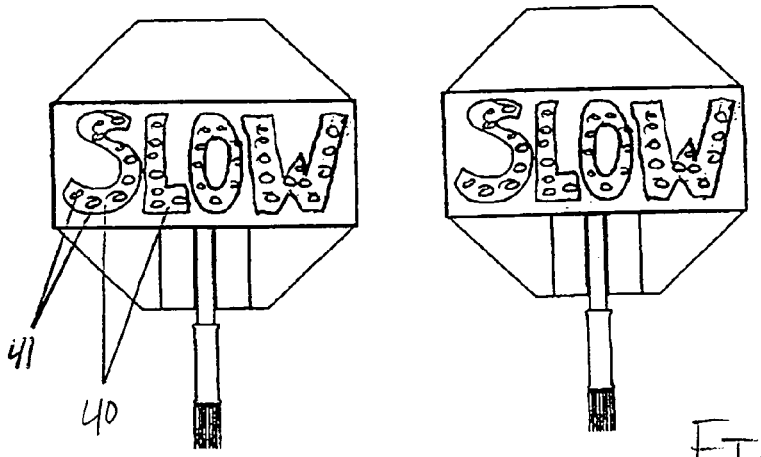

FIG. 20(*a*) depicts a further rendering of a "STOP-STOP" advisory; FIG. 20(*b*) depicts a further rendering of a "STOP-SLOW" advisory; and FIG. 20(*c*) depicts a rendering of a "SLOW-SLOW" advisory, all of which advisories represent common or typical advisories. It is contemplated that other advisories may easily be rendered upon the sign with appropriate adjustments. It will be seen from an inspection of FIGS. 20(*a*) through 20(*c*), that the present invention may further comprise reflective materials (paint or tape) 40 formed adjacent LED lights 22 so that a reflective material advisory appears in tandem with the LED light advisory. LED lights 22 are designed to shine through round apertures 41 as further referenced in FIGS. 1, and 20(*a*) through 20(*c*). It will thus be understood that advisories or legends may be painted with reflective materials with round apertures 41 for allowing light emanating from LED lights 22 to pass therethrough. Thus, the user may provide warnings or advisories even if the LED lighting turned off or otherwise inoperative. Reflective materials 40 and round apertures 41 are further illustrated and referenced in FIG. 22.

In other embodiments, light panel 13 could include a plurality of LED lights 22 and could be programmable so that the message(s) programmed will light up only the appropriate LED lights 22 to display the message. For illustration purposes only, the word, "STOP" uses 57 pixels and the word "SLOW" uses 63 pixels—the number of pixels varying depending upon the diameter of the pixels. Moreover, in particular where the messages are programmed, an additional feature is a microprocessor chip capable of holding messages in memory to preserve messages and/or to continue to display messages on traffic control sign assembly 10 even when the main power source (i.e. battery 15 and the like) expire.

Other key features of the present invention are diffused or prismatic panels 14, or prismatic panels as they are known in other embodiments. Diffused or prismatic panels 14 are preferably mounted in each control console 12 in central alignment on opposite sides of central opening 17. Diffused or prismatic panels 14 are preferably prismatic, meaning that they spread or diffuse light energy. Diffused or prismatic panels 14 thus preferably provide a cover for one side of the respective control console 12 and two-sided bread board type LED light panel 13.

In a preferred embodiment, first silk screen 20 bears the legend "STOP" and is located on the back of one of diffused or prismatic panels 14; further, second silk screen 20 bears the either the legend "STOP" or the legend "SLOW" and is located on the back of the other of diffused or prismatic panels 14. These silk screen legends are then aligned with LED lights 22 so that the spread of the light thereby increases the brightness and clarity of the message. The alignment and usage of the diffused (prismatic) panels 14 increases the distance from which the message can be read to up to ⅛ mile from traffic control sign assembly 10 and the angle of view of light panel 13 so that the message can be read from up to a 170 degree line of sight from the center of sign 11.

The ability to read the message from practically any orientation of traffic control sign assembly 10 dramatically increases the effectiveness of traffic control sign assembly 10 and practically overcomes any error in orientation of traffic control sign assembly 10 in the field, such as when the holder has accidentally turned planar portions of traffic control sign assembly 10 somewhat away from oncoming traffic. As discussed above, the messages on both sides of traffic control sign assembly 10 can then be read and understood at nearly all angles and from a large distance, thus improving protection of both the reader and the holder and people at the site at issue. Diffused or prismatic panels 14 are preferably constructed from phenolic type material (i.e. a type of reflective sheet covering) including pyramid type cones (i.e. dimpled) upon a surface thereof to deflect the light in all directions and to spread the light to enhance and equalize the brightness within the "pixel-looking" circles.

A power source, such as batteries 15 in a preferred embodiment, are mounted (i.e. preferably horizontally) on an underside of control consoles 12 in battery or power source compartments 23 as are illustrated and referenced in FIGS. 1, 9–13, and 15–15(*c*) and are connected to two-sided bread board type LED light panel 13 for providing electrical power to light two-sided bread board type LED light panel 13. In addition, it is contemplated that a low battery sound indicator 24 as referenced in FIG. 19 and automatic shut-off/shut-down of two-sided bread board type LED light panel 13 are provided as added features of the present invention. It is contemplated that other power sources, such as solar power and external power, may be utilized to power certain electric circuitry contained in traffic control sign assembly 10.

For example, it is contemplated that the present invention provides means for converting and using power from a source such as the cigarette lighter of any vehicle (e.g. an emergency vehicle) using a standard power inverter or from an external battery pack, which pack may be included in a traffic control sign assembly kit, as described in more detail hereinafter. In addition, the battery-powered power source can include battery packs (i.e. venus type), the preferred embodiment being two D-size cell battery packs with one pack for each side of the LED lights, and other larger 8-battery packs being used to increase battery life for traffic control sign assembly 10. The battery pack can also be recharged whether by direct plug-in cord adaptor with standard voltage ratings or by removal of the battery pack from traffic control sign assembly 10 and placement on a standard charger.

It should be noted (by way of example) that the control console may be plugged into any of the following external power sources: any vehicular cigarette lighter (12V direct current) by utilizing a power converter assembly (provided separately or provided with the traffic control sign assembly kit); any vehicle with a generator (e.g. emergency vehicles) supplying alternate current by utilizing a power inverter assembly (provided separately or provided with the traffic control sign assembly kit); or a standard external battery pack consisting of up to 16 batteries for longer life of LED lights 22.

As earlier stated, in order to make traffic control sign assembly 10 sturdy and practical for field use, the present invention makes use of means for connecting control consoles 12 to sign 11 and each other in unitary assembly. Said means may be further defined by comprising silicone glue fastening means 25 (referenced in FIG. 14) so as to keep components from "shearing off" if traffic control sign assembly 10 is otherwise dropped or jarred and further for keeping the unit water tight and usable in all weather conditions.

In addition, various spacers, insulating materials, connectors and standoffs are used as needed. In this regard, it is contemplated that a rubber type edge molding 26 is placed around the entire light panel 13 prior to insertion into central opening 17 to strengthen the attachment therein and to secure light panel 13 in case traffic control sign assembly 10 is bumped or dropped. Edge molding 26 is illustrated and referenced in FIGS. 2, 12, 13, and 18.

Figure 15B:
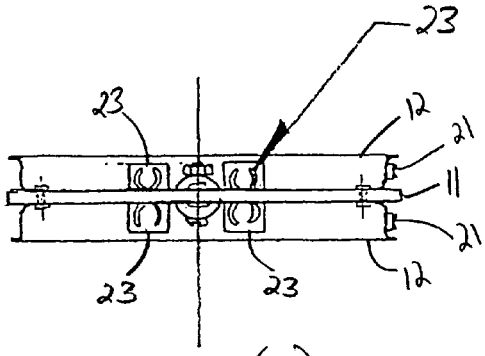
FIG. 15 is a fragmentary enlarged plan view of a fourth preferred traffic control sign assembly bearing no legend upon the prismatic panel and showing the first handle assembly.
Figure 15C:
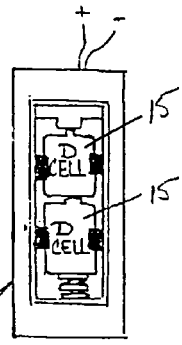
Figure 15:
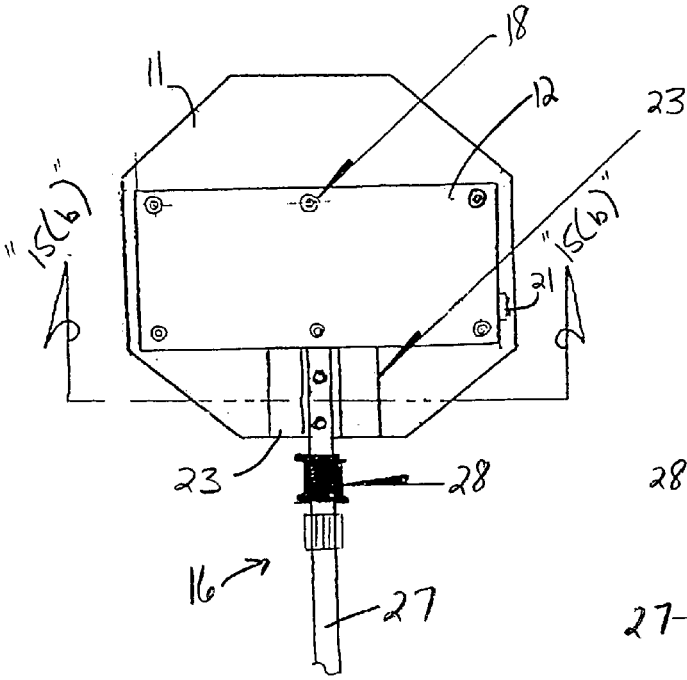
Figure 15A:
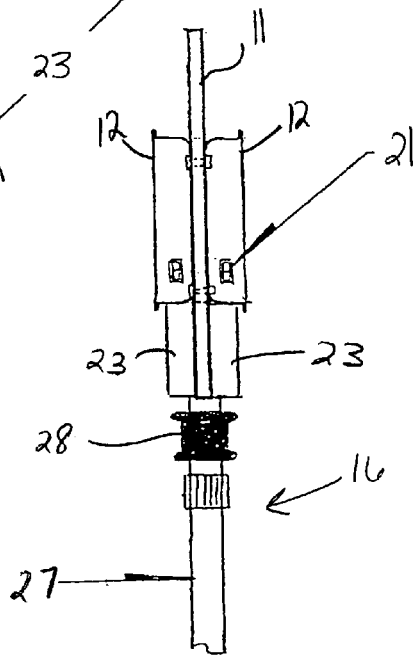

Another important feature of the present invention is switch means, shown at 21 in FIGS. 15 and 15(*a*), preferably defined by three-way selector switch means in a preferred embodiment. The switch means operate to activate the power source between "OFF", continuous on, and flashing sequence modes so that the power source can then operate each set LED lights 22 on the opposing surfaces of traffic control sign assembly 10 independently and in any of the various modes. A preferred flashing sequence includes five flashes of LED lights 22 followed by 2 to 15 seconds where LED lights 22 are continuously on. Other flashing sequences can be programmed as needed. A generalized circuitry drawing is included as FIG. 19. The continuous ON and flashing modes, for example, coact with the diffused or prismatic panel structure so as to enable traffic control sign assembly 10 to be seen up to ⅛ of a mile before the headlights of on-coming vehicles hit the standard reflective signs and to give the holder of traffic control sign assembly 10 far greater safety in being seen. In another embodiment, the present invention also contemplates the usage of a strobe light located atop the sign for additional protection of the user and to draw further attention to the message.

An additional significant feature of the present invention, as generally referenced in FIGS. 9–12, 15, and 15(*a*), is handle assembly 16. Handle assembly 16 is preferably secured to sign 11 for enabling traffic control sign assembly 10 to be hand held by a person, in a preferred embodiment. Handle assembly 16 preferably includes different embodiments including a telescoping handle 27 as illustrated and referenced in FIGS. 15 and 15(*a*). Handle 27 preferably comprises screw means for screwed-in attachment and detachment means, a collapsible tripod embodiment for hands-free use, a modular or multi-sectioned handle that has screw attachment means, and a weighted base self-supporting stanchion embodiment that rests upon the ground. Handle assembly 16 may further preferably comprise a slide-on grip 28 as illustrated and referenced in FIGS. 9, 10, 11, 15, and 15(*a*) and telescoping handle 27 can extend traffic control sign assembly 10 to over 6 feet high for better message visibility. Handle assembly 16 may preferably be constructed from wood, plastic, or metal materials, and may be slotted so as to be received and yoked or interlocked with the sign. It should be noted that handle assembly 16 should be of sufficient weight so that traffic control sign assembly 10, in total, weigh approximately 5 pounds or less. Although not shown, other usages contemplated for the sign can include attachment to vehicles, such as school buses.

Figure 21:
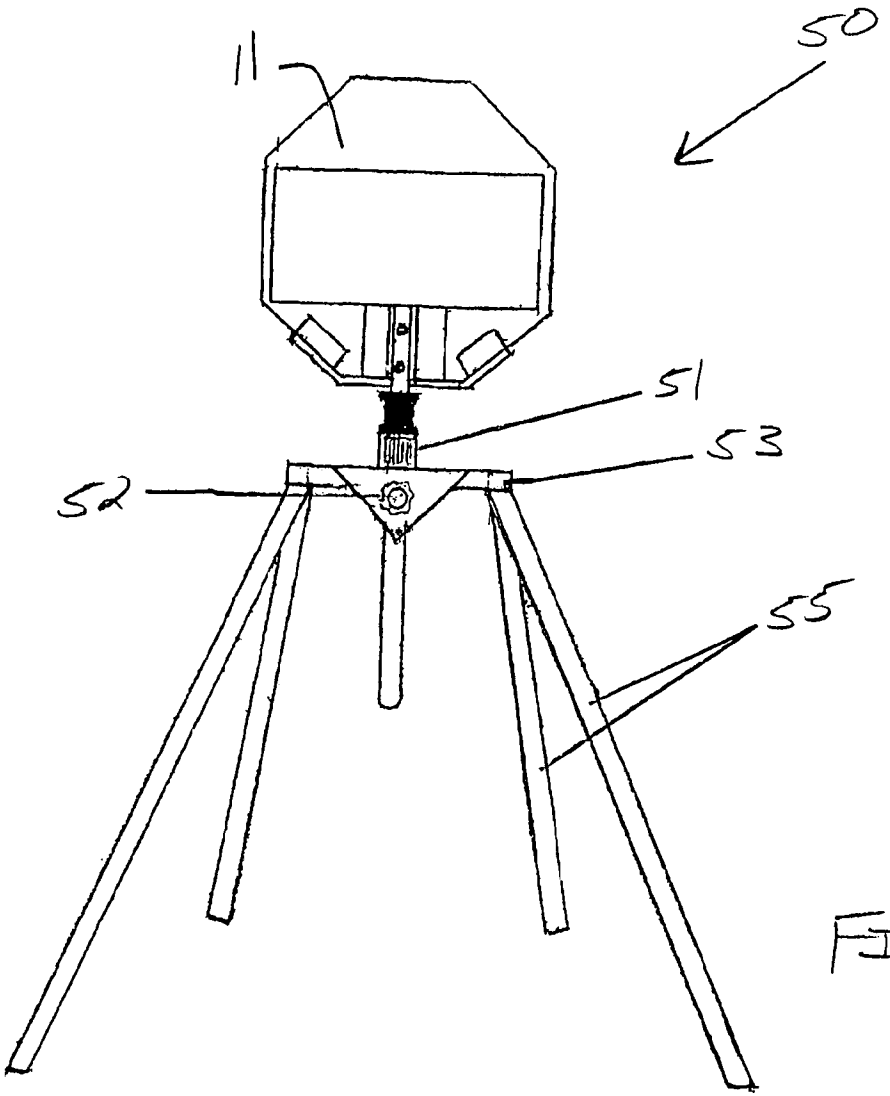
FIG. 21 is a front view of a stand-mounted traffic control sign assembly.
Figure 22:
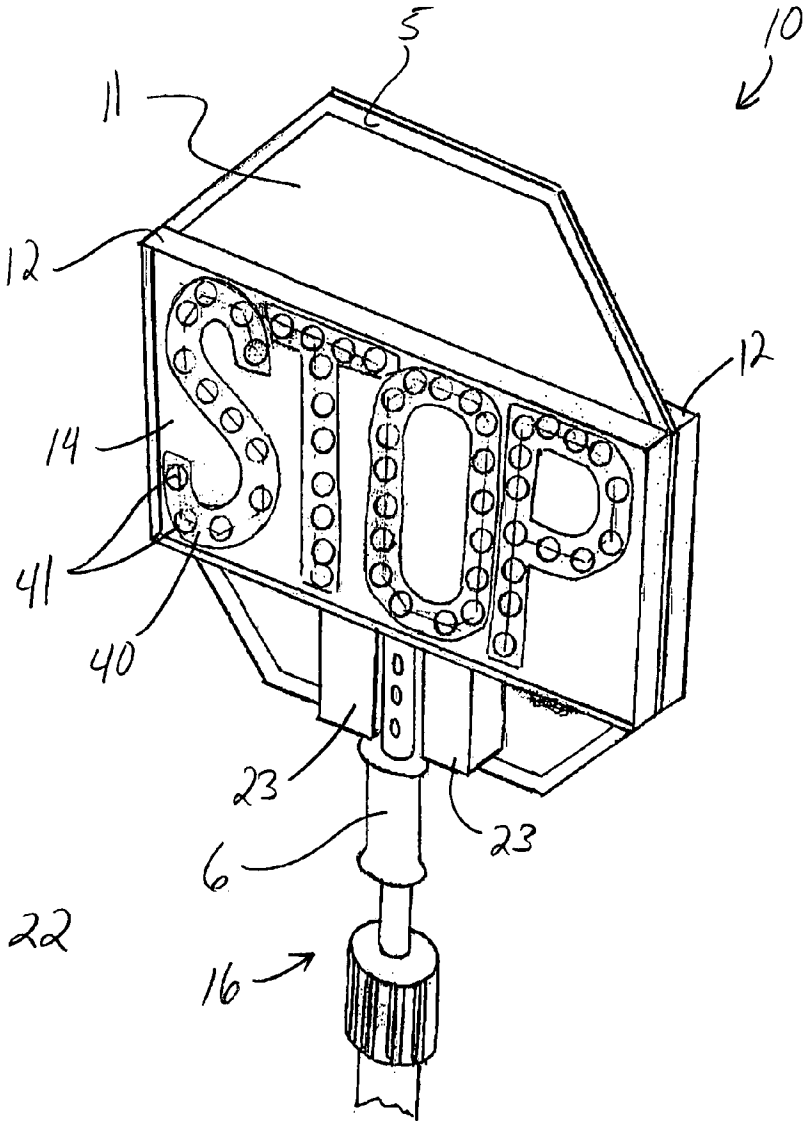
FIG. 22 is a fragmentary top perspective view of the traffic control sign assembly in an assembled state showing a first handle assembly and optional reflective materials upon the prismatic panels.

Further, it is contemplated that a hands-free, stand-mounted traffic control sign assembly 50 (as may be seen from an inspection of FIG. 21) may enable the user to temporarily situate the sign assembly so that the user may be free to perform other activities (other than holding sign assembly 10). From an inspection of FIG. 21, it will be seen that stand-mounted traffic control sign assembly 50 preferably comprises sign 11; a threaded sleeve 51; a locking knob 52; a tripod or four-legged stand 53; and a telescoping pole 54. Threaded sleeve 51 threads up onto base of the handle. The tripod or four-legged stand 53 may preferably comprise foldable legs 55 for portability. Telescoping pole 54 is designed for height adjustment as does locking knob 52. Note that the same telescoping pole may be utilized for the hand-held traffic control sign assembly or the stand-mounted traffic control sign assembly. With regard to the hand-held version, it is contemplated that a grip 6 (as referenced in FIGS. 1 and 22) may be utilized in combination with handle assembly 16 to provide the holder with more comfortable structure with which to grasp and hold traffic control sign assembly 10.

Figure 23:
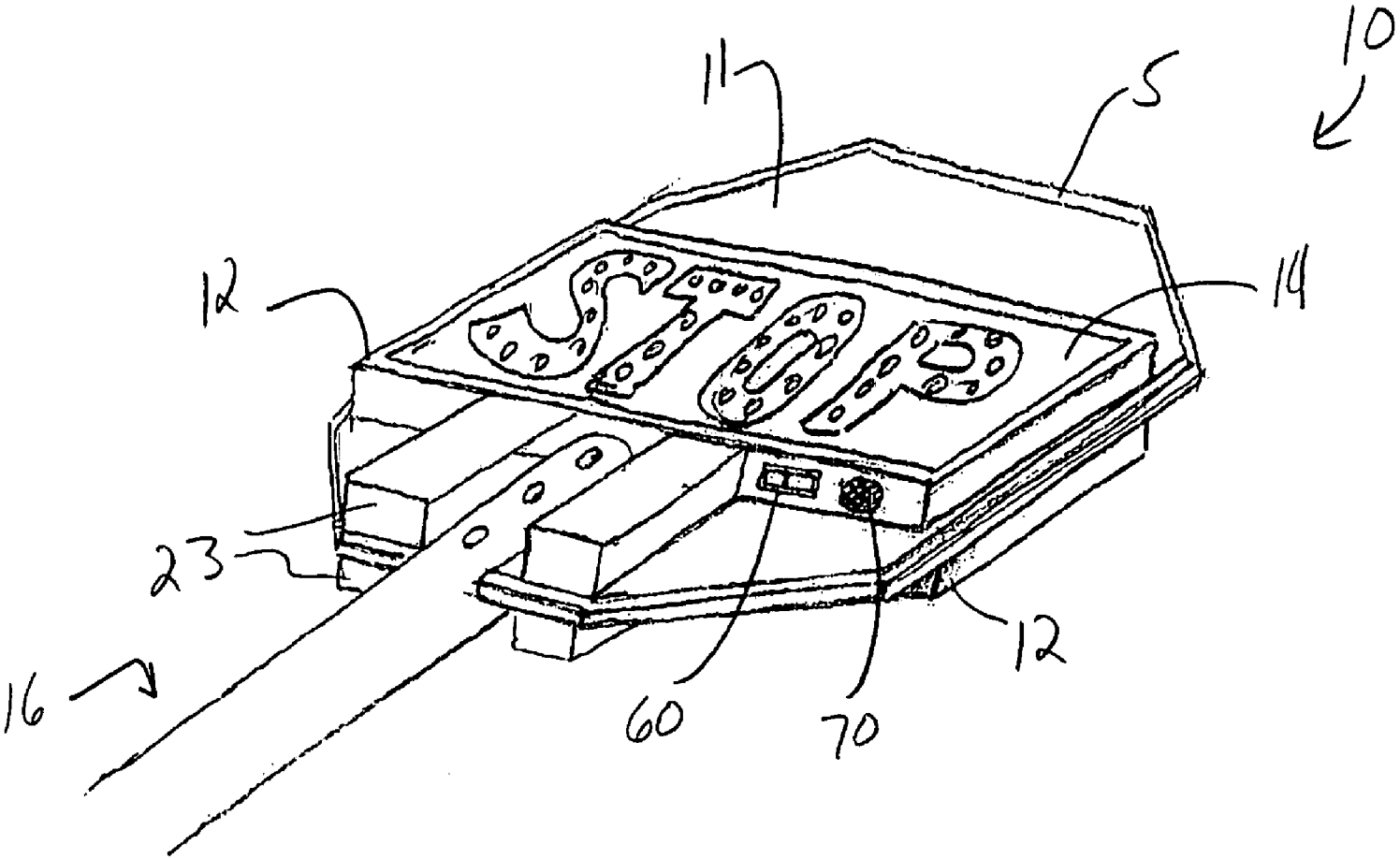
FIG. 23 is a fragmentary bottom perspective view of the traffic control sign assembly in an assembled state showing switch means and low-battery alert means.

FIG. 23 is a fragmentary bottom perspective view of traffic control sign assembly 10 showing switch means 60 and low battery alert means 70. Low battery alert means 70 may be defined by electronically enabled audio means for alerting users to a low battery power state or visual means for alerting users to a low battery power state. Switch means 60 function to provide an OFF, an ON, or a FLASHING (i.e. alternating OFF-ON) LED light condition as desired by the user. It is contemplated that switch means 60 and low-battery alert means 70 are preferably located on the underside or inferior side of one control console 12 with enabling circuitry disposed internal to the sign assembly.

Finally, in another embodiment, a traffic control sign assembly kit is provided. As earlier indicated, the kit essentially comprises: a traffic sign (assembly); a modular handle assembly or telescoping pole assembly; a power source (e.g. batteries, an inverter and cord, vehicular cigarette lighter cord, external battery cord); various accessories; and a carrying case. Thus, the kit preferably comprises sign 11; modular handle assembly or telescoping pole assembly 16; a power source; and a carrying case (not specifically illustrated). Traffic sign 11, as described above, comprises central opening 17 defining an annular sign rim and opposing sides; control consoles 12 may be positioned on each opposing side of traffic sign 11 in centered relation to central opening 17; means connecting control consoles 12 to traffic sign 11 and to each other in unitary assembly; an optionally mirrored, dual-sided LED light panel 13 centrally located within the connected control consoles 12; and a prismatic panel 14 centrally mounted in each control console 12 over the optionally mirrored, dual-sided LED light panel 13 and central opening 17. The power source is electrically connected to the optionally mirrored LED light panel 13 and modular handle assembly 16, which assembly 16 includes screwed-in attachment means for constructing and for securing modular handle assembly 16 to itself and to traffic sign 11. The carrying case is provided for containing the traffic sign (assembly); the modular handle assembly or telescoping pole assembly; the power source (e.g. batteries, an inverter and cord, vehicular cigarette lighter cord, external battery cord); and various other accessories as may be required. The carrying case is sized for carrying traffic sign 11, the power source, and modular handle assembly or telescopic pole assembly 16 in detached form and is preferably constructed of vinyl or plastic materials.

In construction and in use the present invention therefore provides traffic control sign assembly 10 that provides enhanced visual clarity, brightness, and coverage including up to distances of ⅛ mile and at nearly any angle from which traffic control sign assembly 10 can be turned. Traffic control sign assembly 10 is highly visible, distinctly displays the appropriate warning messages, is capable of quickly being powered by various means, and is sturdy, lightweight, adaptable to different sites and under different working conditions, and is easy to use and manufacture.

Alternative Embodiment

Figure 6:
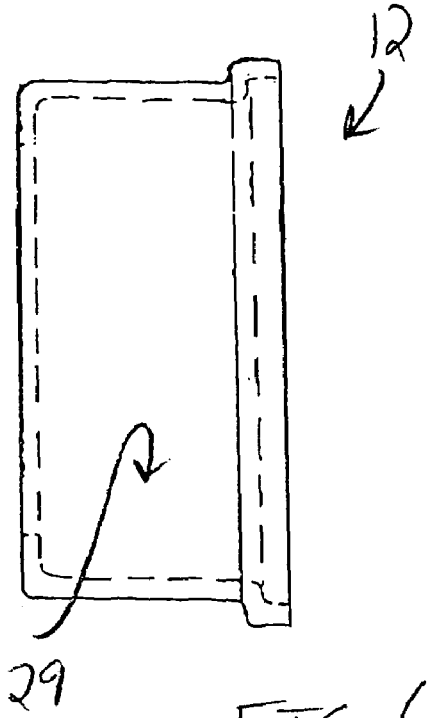
FIG. 6 is a side plan view of one control console of the traffic control sign assembly.
Figure 9:
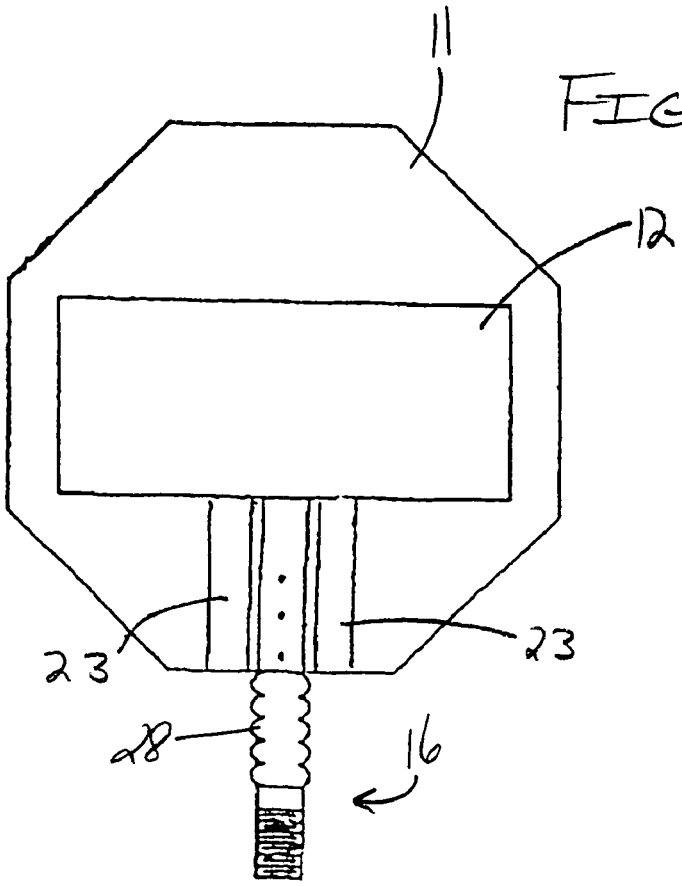
FIG. 9 is a fragmentary enlarged plan view of a second preferred traffic control sign assembly bearing no legend upon the prismatic panel and a second handle assembly.
Figure 10:
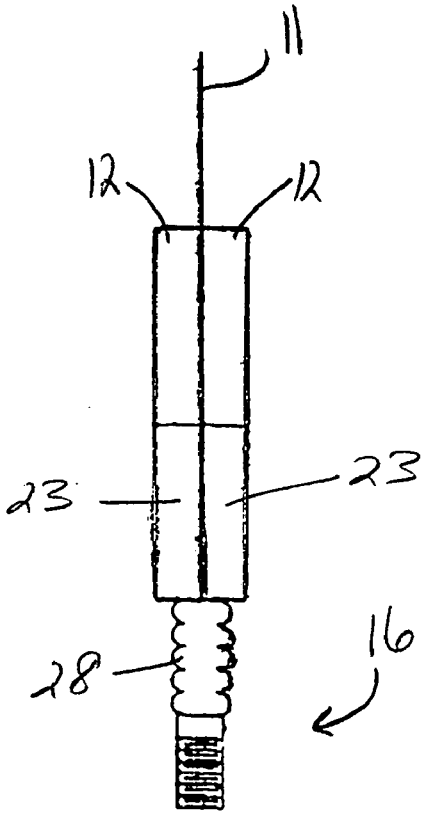
FIG. 10 is a fragmentary edge view of the traffic control sign assembly shown in FIG. 9.
Figure 12:
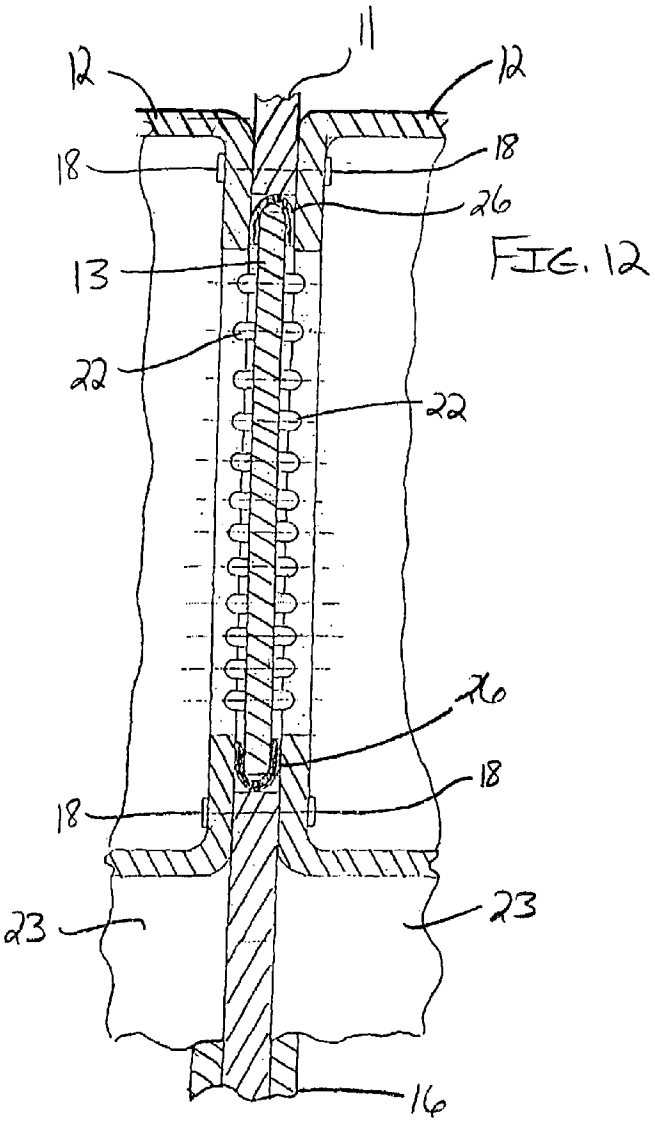
FIG. 12 is a fragmentary enlarged cross-sectional view of the traffic control sign assembly as taken from FIG. 11, showing a two-sided bread board type LED light panel and surrounding structures.
Figure 11:
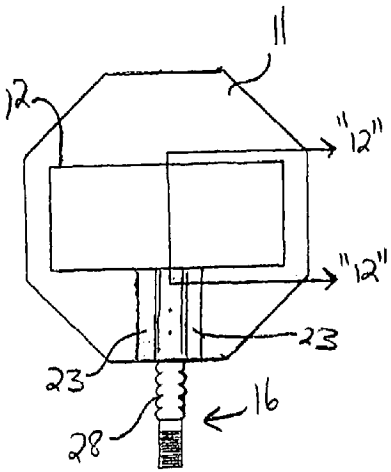
FIG. 11 is a fragmentary reduced plan view of the traffic control sign assembly shown in FIG. 9.
Figure 13:
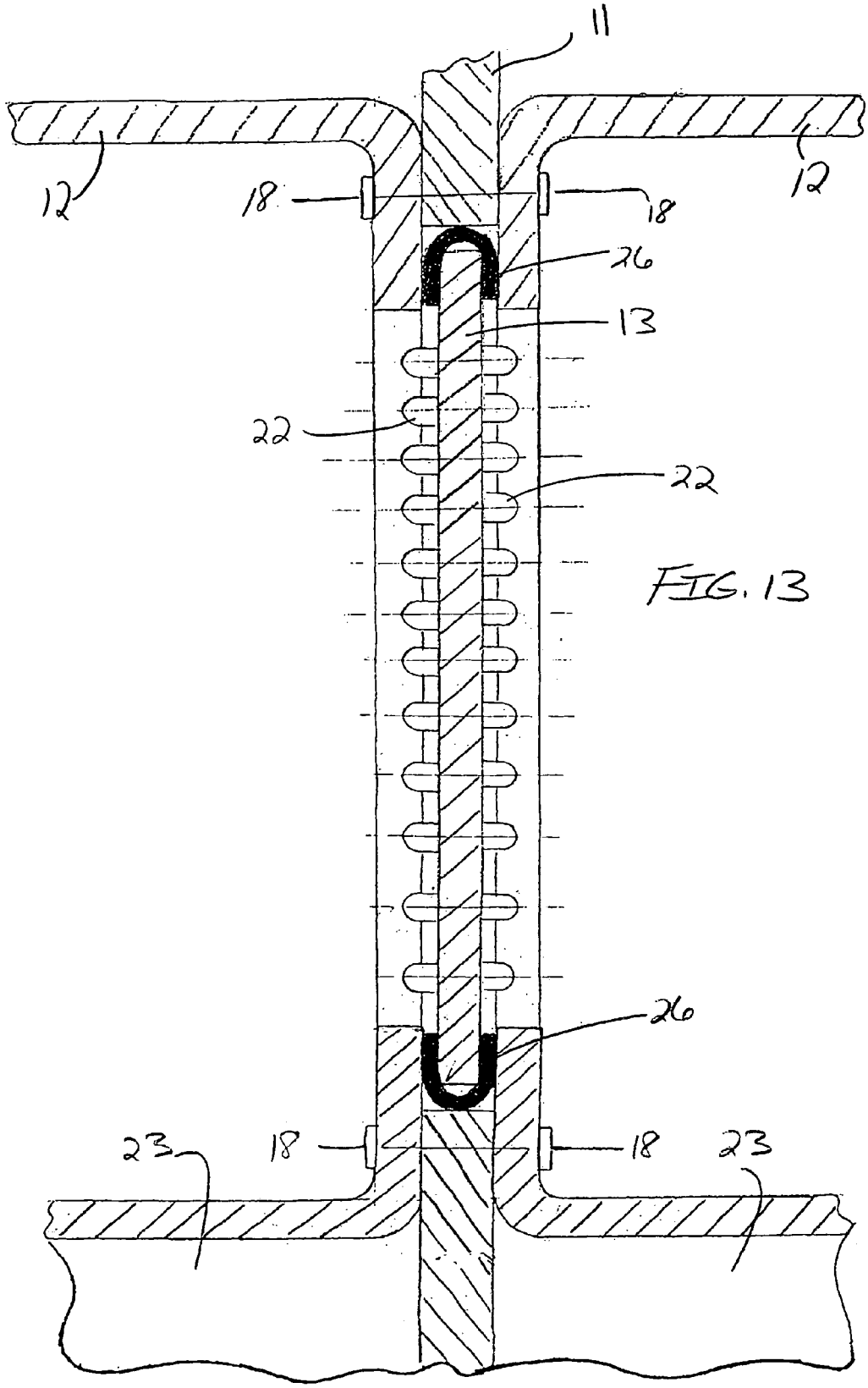
FIG. 13 is a fragmentary enlarged view of the structures otherwise shown in FIG. 12.
Figure 14:
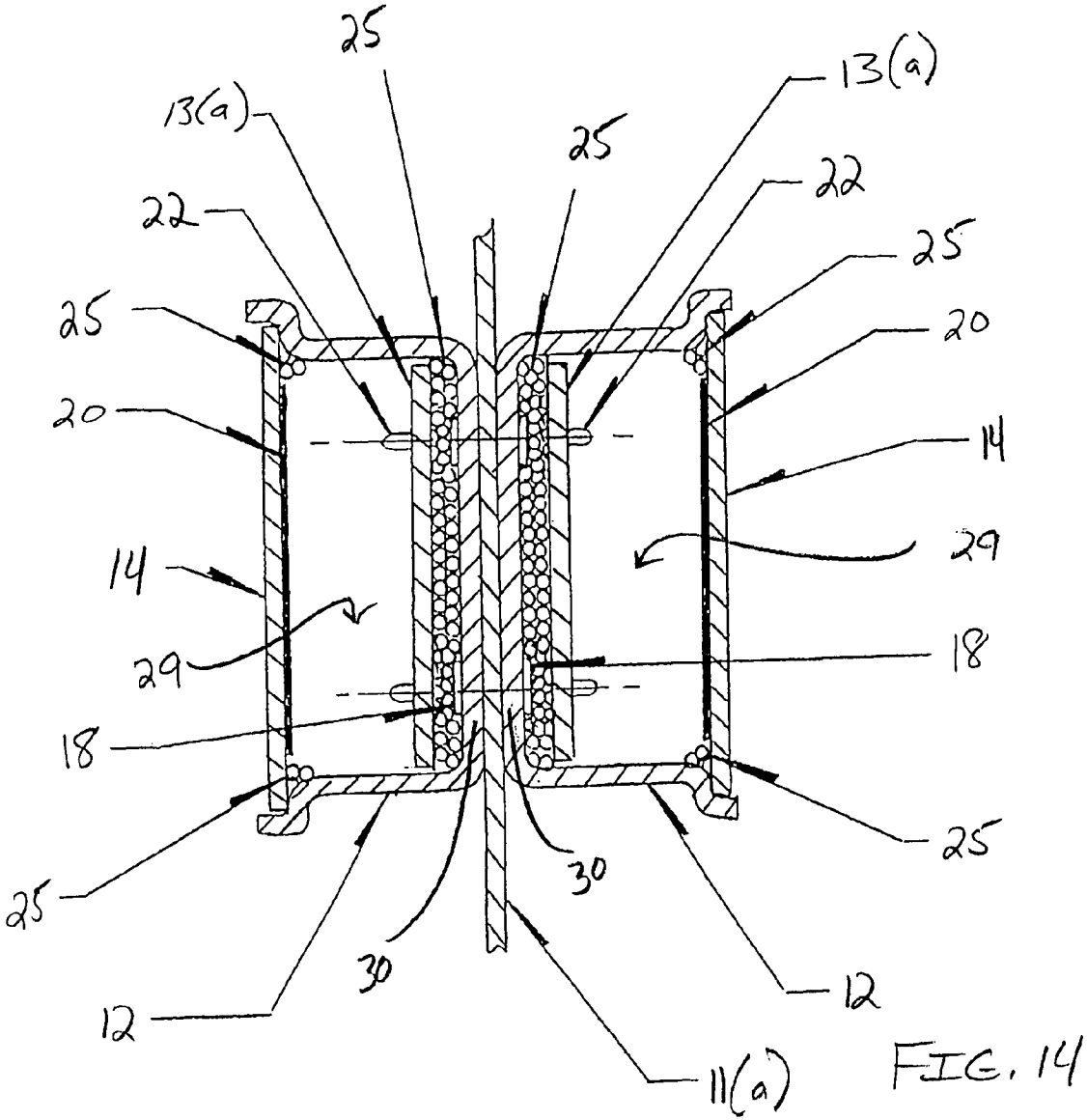
FIG. 14 is a fragmentary cross-sectional view of a portion of a third traffic control assembly, showing two one-sided bread board type LED light panels and surrounding structures.

It is further contemplated that in one alternative embodiment, two-sided bread board type LED light panel 13 may be replaced by two bread board type LED panels 13(*a*), each of which may be attached to the alternative traffic control sign assembly by being received in the space 29 of control console 12, which space 29 is generally referenced in FIGS. 6 and 14. From an inspection of FIG. 14, it will be seen that it is contemplated that silicone glue fastening means 25 may be sandwiched by light panel 13(*a*) and sign attachment structure 30 of each control console 12. It will thus be understood from an inspection of FIG. 14 that alternative sign 11(*a*) is mostly continuous, not comprising central opening 17, but perhaps comprising rivet-receiving structure 19 as may be further gleaned from an inspection of FIG. 14.

While the above description contains much specificity, this specificity should not be construed as limitations on the scope of the invention, but rather as an exemplification of the invention. For example, it is believed that the spirit of the present invention discloses a traffic control sign assembly, which assembly essentially comprises a sign, a control console assembly (comprising two control consoles), light panel means (preferably defined by either light panels 13 or light panels 13(*a*), but alternatively defined by similar other panels for directing light away from the plane in which sign 11 or sign 11(*a*) substantially lie), light diffusion means (preferably defined by diffusion panels 14 or other prismatic panels), and a power source. In this regard, it is contemplated that the sign comprises opposing sign sides and an outer sign perimeter as may be generally understood from a consideration of the foregoing descriptions and figures. Further, the control console assembly essentially comprises oppositely positioned control consoles, the control consoles being positioned on the opposing sides (of the sign) in substantially centered relation to the outer sign perimeter. Means for connecting the control consoles to the sign and to each other in unitary assembly are further essential. The light panel means are thus cooperatively associated with the control console assembly for providing light and for directed the provided light away from the plane in which the sign lies. The light diffusion means are also cooperatively associated with the control console assembly, which means are designed to diffuse the provided light away from and substantially parallel to the sign. The power source is in electrical communication with the light panel means for electrically powering the light panel means. It is further contemplated that the traffic control sign assembly may comprise sign display means (such as the handle assembly) for otherwise supporting the sign, the supported sign for displaying visual messages to approaching viewers or passersby.

Thus, as various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

We claim:

1. A vehicle signal light assembly comprising:

a sign, a pair of control consoles, at least one bread board type LED light panel, first and second light-diffusing panels, batteries, attachment means, first and second silk screens, switch means, and a handle assembly, the sign comprising opposing sign sides and an outer sign perimeter, the control consoles being positioned on opposite sides of the sign in centered relation to the outer sign perimeter, the light panel being cooperatively associated with the control consoles, the light-diffusing panels being mounted in the control consoles in central alignment on opposite sides of the sign, the batteries being mounted on an underside of the control consoles and connected to the light panel for providing electrical power to light the light panel, the attachment means connecting the control consoles to the sign and to each other in unitary assembly, the first silk screen with legend "STOP" on back of one of said light-diffusing panels mounted in one of said control consoles, the second silk screen with legend "STOP" or "SLOW" on back of another of said light-diffusing panels mounted in another of said control consoles, the switch means for turning said batteries "ON" in a holding or a flashing mode and for turning said batteries "OFF," the handle assembly being secured to said sign for enabling the sign to be hand held by a person;

wherein said light-diffusing panels are prismatic and cover each side of said control console and at least one light panel to allow viewing up to a 170 degree line of sight from the center of said sign.

2. The vehicle signal light assembly of claim 1, including allowing on coming traffic to be able to read the sign from any angle of the sign within the 170 degree line of sight and within ⅛ mile from said sign before the headlights of on-coming vehicles hit said sign.

3. A vehicle signal light assembly comprising:

a sign, a pair of control consoles, at least one bread board type LED light panel, first and second light-diffusing panels, batteries, attachment means, first and second silk screens, switch means, and a handle assembly, the sign comprising opposing sign sides and an outer sign perimeter, the control consoles being positioned on opposite sides of the sign in centered relation to the outer sign perimeter, the light panel being cooperatively associated with the control consoles, the light-diffusing panels being mounted in the control consoles in central alignment on opposite sides of the sign, the batteries being mounted on an underside of the control consoles and connected to the light panel for providing electrical power to light the light panel, the attachment means connecting the control consoles to the sign and to each other in unitary assembly, the first silk screen with legend "STOP" on back of one of said light-diffusing panels mounted in one of said control consoles, the second silk screen with legend "STOP" or "SLOW" on back of another of said light-diffusing panels mounted in another of said control consoles, the switch means for turning said batteries "ON" in a holding or a flashing mode and for turning said batteries "OFF" the handle assembly being secured to said sign for enabling the sign to be hand held by a person; and wherein said light-diffusing panels are made of phenolic type material forming "pixel-looking" circles including pyramid type cones upon a surface thereof to deflect the light in all directions and spread the light to enhance the brightness within the "pixel-looking" circles.

4. A vehicle signal light assembly, to be hand held or pole mounted, comprising:

a flat plate sized and shaped in the form of a traffic sign, said traffic sign having a central opening, the central opening being defined by an annular sign rim;

a control console structure secured in centered relation in said central opening and peripherally bounded by said annular rim;

a two-sided bread board type LED light panel mounted in said control console structure;

light-diffusing panels mounted on opposite sides of said control console structure on opposite sides of said central opening;

batteries mounted on an underside of said control console structure and connected to said two-sided bread board type LED light panel providing electrical power to light said two-sided bread board type LED light panel;

means connecting said control console structure internally and to said sign in unitary assembly;

a first silk screen with a traffic legend on back of one of said light-diffusing panels mounted in said control console structure;

a second silk screen with another traffic legend on back of another of said light-diffusing panels mounted on an opposite side of said control console structure;

switch means for turning said batteries "ON" in a holding or a flashing mode and for turning said batteries "OFF"; and wherein said light-diffusing panels are prismatic and cover each side of the control console structure to allow viewing of said two-sided bread board type LED light panel up to 170 degrees from the center of said traffic sign.

5. The vehicle signal light assembly of claim 4, wherein said two sides of said two-sided bread board type LED light panel are lightweight, weighing less than 5 pounds.

6. The vehicle signal light assembly of claim 5, wherein said light-diffusing panels are covered with a phenolic type material for reflection and have pyramid type cones thereon to deflect the light in all directions and which spread the light.

7. The vehicle signal light assembly of claim 6, wherein said means connecting said control console structure internally and to said sign in unitary assembly includes usage of silicone to keep components from "shearing off" if said signal light assembly is dropped or jarred and for keeping unit water tight and usable in all weather conditions.

8. The vehicle signal light assembly of claim 4, wherein said switch means provides said holding and said flashing modes of said two-sided bread board type LED light panel enabling said traffic sign to be seen up to ⅛ of a mile before the headlights of on-coming vehicles hit the standard reflective signs to give the holder of the sign far greater safety in being seen.

9. A traffic control sign assembly comprising:

a sign having a central opening defining an annular sign rim and opposing sides;

a control console positioned on each opposing side of said sign in centered relation to said central opening;

means connecting said control consoles to said sign and to each other in unitary assembly;

a double-sided light panel having LEDs mounted on opposing surfaces, said double-sided light panel centrally located in said connected control consoles;

a light-diffusing panel centrally mounted in each control console over each opposing surface of said double-sided LED light panel and said central opening;

a power source electrically connected to said double-sided LED light panel;

a handle assembly secured to said sign for supporting said sign; and wherein a first silk screen with a first legend "STOP" is located on the back of one of said light-diffusing panels and a second silk screen with a second legend "STOP" or "SLOW" is located on the back of another of said light-diffusing panels, said first and second legends corresponding to an arrangement of LED lights on each opposing surface of said double-sided light panel for enhancing the brightness and clarity of said arrangements of LED lights for viewing up to ⅛ mile from said sign and in a 170 degree line of sight from the center of said sign.

* * * * *